United States Patent [19]

Krenz

[11] Patent Number: 4,538,875

[45] Date of Patent: Sep. 3, 1985

[54] STRAIN RELIEF CLIP FOR ELECTRICAL CABLE

[75] Inventor: Horst M. Krenz, St. Joseph, Mich.

[73] Assignee: Heath Company, St. Joseph, Mich.

[21] Appl. No.: 630,150

[22] Filed: Jul. 12, 1984

[51] Int. Cl.[3] ..... H01R 13/58

[52] U.S. Cl. ..... 339/103 R; 339/75 P

[58] Field of Search ..... 248/63, 71; 24/121, 24/122, 129 R, 129 B, 129 C, 131 R, 458; 339/103 R, 103 M, 75 P, 104

[56] References Cited

U.S. PATENT DOCUMENTS

| | | | |
|---|---|---|---|
| 2,057,587 | 10/1936 | Place | 24/458 X |
| 2,618,033 | 11/1952 | Tinnerman et al. | 24/129 B |
| 3,012,745 | 12/1961 | Donovan | 248/71 |

*Primary Examiner*—Eugene F. Desmond

[57] ABSTRACT

A metal clip is capable of securely engaging an electrical cable along the length thereof and is adapter for insertion and stable positioning within an elongated ventilation slot in the cabinet or chassis of an electronic apparatus to provide strain relief for the electrical cable. The strain relief clip may be in the form of either an appropriately twisted and bent metal wire or an appropriately configured solid metal clip formed by stamping. By providing a secure mounting for the electrical cable to the electronic device to which the cable is electrically coupled, movement between a connector located between the end of the cable and a receptacle mounted to, for example, a printed circuit board within the electronic device is prevented and electrical continuity is maintained.

9 Claims, 10 Drawing Figures

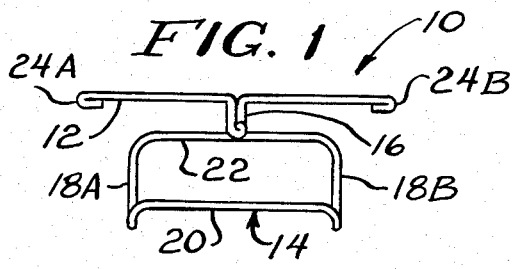
FIG. 1
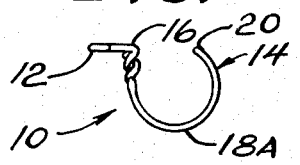
FIG. 2
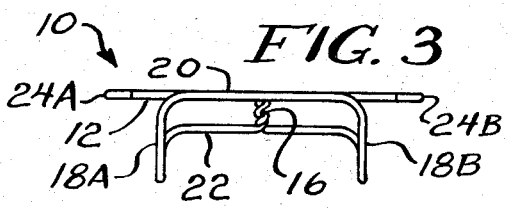
FIG. 3
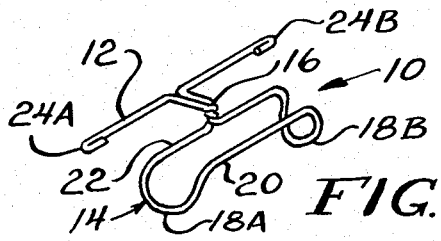
FIG. 4
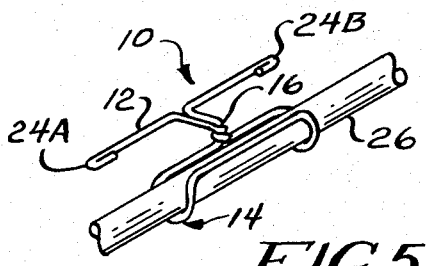
FIG. 5
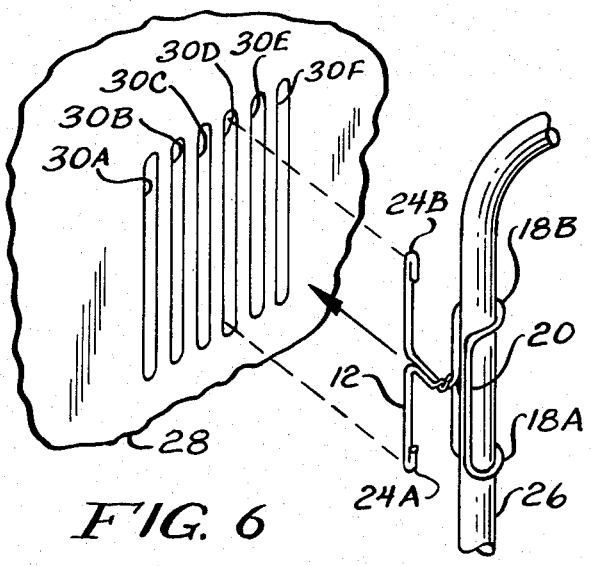
FIG. 6
FIG. 7
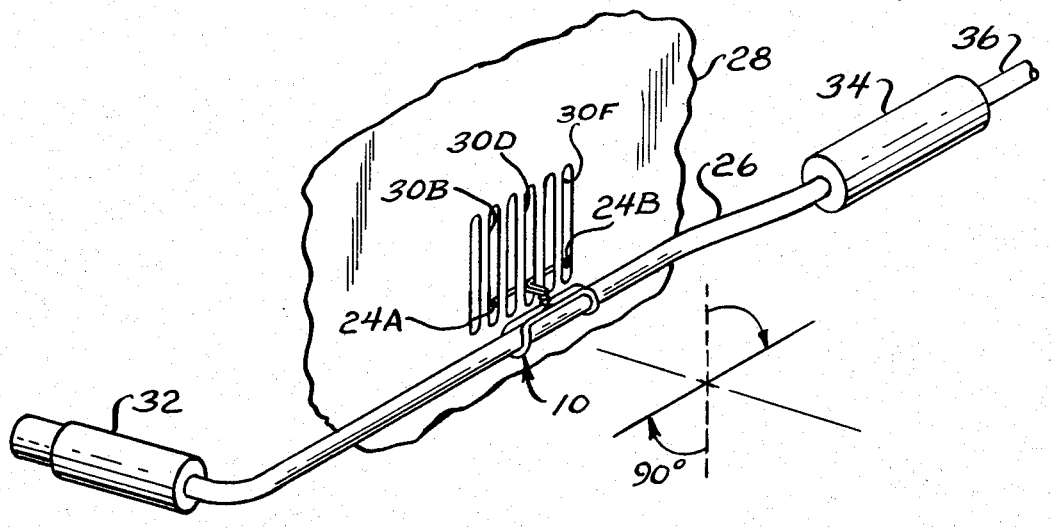

FIG. 8
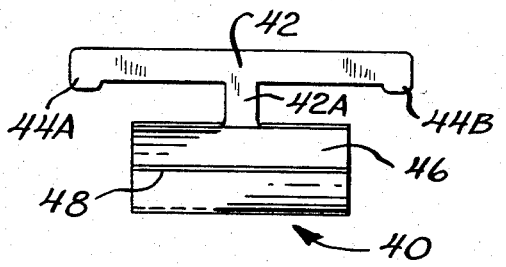
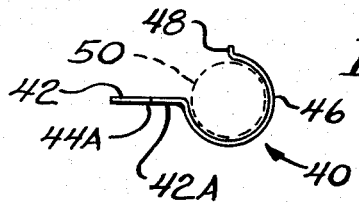
FIG. 9
FIG. 10
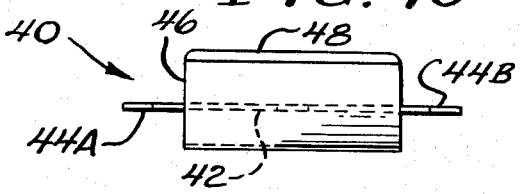

STRAIN RELIEF CLIP FOR ELECTRICAL CABLE

BACKGROUND OF THE INVENTION

This invention relates generally to electrical cable installations and is particularly directed to the elimination of strain in a flexible electrical cable coupled to an electronic device.

An electrical lead, or cable, to an electrically energized device is coupled to a connector either in the cabinet or chassis of the device or passes therethrough and is coupled to a connector internal to the device. In either case, it is essential that continuity be maintained between the lead and the connector to which it is coupled for proper operation of the device. The integrity of this electrical coupling is frequently maintained by a "strain relief" device which, in general, securely attaches the lead along the length thereof to the chassis or cabinet. In this manner, displacement of a distal portion of the lead or the application of tension thereto does not cause the displacement of the end of the lead proximally positioned with respect to the electrical, or electronic, device to which it is coupled. Thus, electrical continuity is maintained and continued operation of the device is ensured.

Prior art strain relief arrangements have generally been overly complex and expensive in performing a relatively uncomplicated and straightforward, yet absolutely essential, function. For example, one approach has been to attach a clamp-like member to the cabinet or chassis with the electrical lead tightly engaged therebetween. The strain relief clamp is generally attached by means of a screw which not only requires an additional component, but also involves an overly complicated and lengthy installation time and requires a certain level of manual dexterity of the assembler. In addition, the strain relief arrangement frequently requires a uniquely configured electrical cable engaging clip which is not only limited to a specific installation, or device, but is also overly complicated and expensive. Other installations require the crimping of the strain relief element about the electrical lead precluding its re-use in the event the lead is removed from the electronic device such as for repair or maintenance.

The present invention is intended to overcome the aforementioned limitations of the prior art by providing a strain relief clip for an electrical cable which is inexpensive, easily installed and removed without tools, re-usable, and unobtrusive. The unitary strain relief clip of the present invention includes integrally coupled first and second portions which are respectively adapted to securely engage an electrical lead and to be inserted within an elongated vent aperture in the chassis or cabinet of an electronic device in securely attaching the lead to the device.

OBJECTS OF THE INVENTION

Accordingly, it is an object of the present invention to provide an improved electrical cable installation in an electronic device.

It is another object of the present invention to provide strain relief for an electrical lead.

Yet another object of the present invention is to securely couple an electrical cable along the length thereof to the chassis or cabinet of an electronic apparatus to which the cable is electrically connected in maintaining the integrity and continuity of the electrical connection therebetween.

Still another object of the present invention is to provide for improved electrical connection between movable electronic modules, particularly between a remote keyboard and a portable computer terminal.

A further object of the present invention is to provide a low cost, compact, easily installed and removed device for securely coupling an electrical lead along the length thereof to the cabinet or chassis of a device to which the lead is electrically coupled in providing strain relief for the electrical lead.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is a top plan view of one embodiment of a strain relief clip in accordance with the present invention in the form of a uniquely configured metal wire;

FIG. 2 is an end-on view of the strain relief clip of FIG. 1;

FIG. 3 is a front view of the strain relief clip of FIG. 1;

FIG. 4 is a perspective view of the strain relief clip of FIG. 1;

FIG. 5 is a perspective view showing the manner in which an electrical lead, or cable, is engaged by the strain relief clip of FIG. 1;

FIGS. 6 and 7 show the manner in which the strain relief clip of the present invention is inserted within a vent aperture in a cabinet, or chassis, for securely coupling an electrical lead thereto;

FIG. 8 is a top plan view of a second embodiment of a strain relief clip in accordance with the present invention in the form of a single, solid, stamped-out element;

FIG. 9 is an end-on view of the strain relief clip of FIG. 8; and

FIG. 10 is a front view of the strain relief clip of FIG. 8.

DETAILED DESCRIPTION OF THE PREFERRED EMBODIMENTS

Referring to FIGS. 1, 2, 3 and 4, there are respectively shown top plan, end-on, front, and perspective views of a strain relief clip 10 in accordance with one embodiment of the present invention. The strain relief clip 10 shown in these various views is comprised of a single, elongated piece of metal wire, preferably of stainless steel spring wire, uniquely shaped and configured as described below.

The respective ends of the metal wire forming the strain relief clip 10 are formed into hook-shaped engaging ends 24A, 24B. All of the portions of the strain relief clip 10 discussed below are located intermediate the respective engaging ends 24A, 24B and along the length thereof. The strain relief clip 10 includes a contoured forward portion 14 coupled to an elongated aft portion 12 by means of an interconnecting portion 16. All of the aforementioned sections of the strain relief clip 10 are integral and continuous with one another and are discussed in terms of being separate portions of the strain relief clip only because of their relative position therein.

The contoured forward portion 14 of the strain relief clip 10 includes generally parallel, linear outer and inner sections 20, 22 which are coupled at respective ends thereof by the arcuate end portions 18A and 18B. The combination of the inner and outer sections 20, 22 and the arcuate end portions 18A, 18B of the countoured portion 14 of the strain relief clip form a generally cylindrical shape open at the ends and along an upper portion thereof. The upper portion of the thus formed clyindrical shape along the inner section 22 of the contoured forward portion 14 of the strain relief clip is coupled by means of the interconnecting portion 16 to the elongated aft portion 12 thereof. The elongated aft portion 12 of the strain relief clip 10 is comprised of two sections, each immediately adjacent a respective engaging end 24A, 24B thereof. The interconnecting portion 16 of the strain relief clip is formed by twisting the metal wire folded along its length such that the sections of the elongated aft portion adjacent respective end portions thereof are of approximately equal length. The twist thus put in the strain relief clip not only forms the interconnecting portion 16 thereof but also separates and defines the elongated aft and contoured forward portions 12, 14 thereof. The elongated aft portion 12 of the strain relief clip 10 is generally parallel to the axis of the cylindrical-shaped contoured forward portion 14 thereof.

Because the strain relief clip 10 is preferably comprised of a metal wire it possesses a certain amount of resilience. Thus, the contoured forward portion 14 thereof is adapted to be opened somewhat by the insertion of an electrical cable 26 therein along the length thereof as shown in FIG. 5. Once inserted within the contoured forward portion thereof, the resilient strain relief clip 10 securely engages the electrical cable 26 along a portion of its length. However, the electrical cable 26 may be removed from the strain relief clip 10, if desired, by merely withdrawing it from the contoured forward portion 14 thereof by displacing the outer and inner sections 20, 22 of the contoured forward portion 14 apart allowing the electrical cable 26 to be withdrawn from the strain relief clip 10.

Referring to FIGS. 6 and 7, the manner in which the electrical cable engaging strain relief clip 10 is mounted to the chassis, or cabinet, of an electrically energized device is shown. In the following discussion, the terms "cabinet" and "chassis" are used interchangeably and should be thought of as equivalents relative to the strain relief clip 10 of the present invention. As shown in FIGS. 6 and 7, the cabinet 28 of an electronic device includes a plurality of elongated, parallel vent apertures 30A through 30F which allow for the circulation of air within the electronic device for cooling the internal components thereof. A shown specifically in FIG. 6, the elongated aft portion 12 of the strain relief clip 10 is aligned parallel to the elongated vent apertures to permit this portion of the strain relief clip 10 to be inserted through one of the vent apertures. As shown in FIG. 6, the elongated aft portion 12 of the strain relief clip 10 is inserted through vent aperture 30D along the length thereof. With the elongated aft portion 12 of the strain relief clip 10 thus inserted through vent aperture 30D, the interconnecting portion 16 of the strain relief clip 10 is positioned within the vent aperture 30D. Once inserted within vent aperture 30D, the strain relief clip 10 is rotated 90°, as shown in FIG. 7, such that the elongated aft portion 12 thereof is oriented generally at a right angle relative to the longitudinal axis of the vent apertures. With the strain relief clip 10 thus rotated 90°, the respective engaging ends 24A, 24B of the elongated aft portion 12 thereof are positioned within vent apertures 30B and 30F. The hook-shaped engaging ends 24A, 24B thus engage a respective edge of the cabinet 28 defining a lateral portion of vent apertures 30B and 30F, respectively. Thus, with its elongated aft portion 12 positioned adjacent a first, inner surface of the cabinet 28 and its contoured forward portion 14 positioned adjacent a second, outer surface of the cabinet 28, the combination of the strain relief clip 10 and the electrical cable 26 is firmly coupled to the cabinet 28. This connection is further enhanced by the coupling between the engaging ends 24A, 24B of the elongated aft portion 12 of the strain relief clip 10 with those portions of the cabinet 28 defining vent apertures 30B and 30F. It should be noted, however, that while the engaging ends 24A, 24B of the elongated aft portion 12 of the strain relief clip 10 increase the extent of coupling of the electrical cable 26 to the cabinet 28, they are not essential in carrying out the principles of the present invention.

As shown in FIG. 7, one end of the cable 26 is coupled to a first connector 32 which may be either positioned outside of or within an aperture in the cabinet 28 or may be positioned entirely within the cabinet 28, with the cable 26 extending through an aperture in the cabinet 28. The first connector 32 electrically couples the cable 26 to electrical/electronic circuitry within the electrical/electronic device positioned within cabinet 28. The other end of the electrical cable 26 may be coupled to a second connector 34 which, in turn, is coupled to a second electrical cable 36. From FIG. 7, it can be seen that positioning of the strain relief clip 10 within the combination of vent apertures 30B, 30D and 30F allows for the generally vertical displacement of the combination of the strain relief clip 10 and the electrical cable 26 with respect to the cabinet 28. However, displacement of the electrical cable 26 along its length is prevented by its engagement with the strain relief clip 10 and the positioning of the strain relief clip 10 within vent aperture 30D. Thus, while the combination of the strain relief clip 10 and the electrical cable 26 is not rigidly mounted to the cabinet 28 so as to preclude any displacement therebetween, coupling between the combination of strain relief clip 10 and electrical cable 26 and the cabinet 28 is such as to preclude the electrical cable 26 from being disconnected from the first connector 32 so as to ensure and maintain the integrity of the electrical connection therebetween.

Referring to FIGS. 8, 9 and 10, there are respectively shown in top plan, end-on, and front views of a second embodiment of a strain relief clip 40 in accordance with the present invention. The strain relief clip 40 shown in FIGS. 8–10 is comprised of a solid, flat metal piece which is formed such as by stamping in the shape shown and described below.

The strain relief clip 40 is comprised of a generally T-shaped aft portion 42 coupled to an arcuate forward portion 46 having a generally cylindrical shape which is open at both ends and along the length thereof. Positioned on respective ends of the T-shaped aft portion 42 are projections 44A and 44B. As shown in FIG. 9, the T-shaped aft portion 42 is coupled to one end of the curved portion of the arcuate forward portion 46, while on the other, opposite end thereof, is positioned an extended, angled end portion 48. With the strain relief clip 40 comprised of a metal such as stainless steel, its resilience permits an electrical cable 50 having a generally circular cross section to be inserted within the arcuate forward portion 46 thereof as shown in FIG. 9. The T-shaped aft portion is coupled to the arcuate forward portion 46 by means of its base portion 42A. With the T-shaped aft portion 42 inserted within an elongated, linear vent aperture as shown in FIGS. 6 and 7 and rotated 90° therein, the base portion 42A of the aft portion 42 will be positioned within a vent aperture. Similarly, the end projections 44A, 44B on the aft portion 42 of the strain relief clip 40 will be positioned within adjacent vent apertures as shown in FIG. 7 for engagement therewith. In this manner, the strain relief clip 40 will be prevented from being rotated within the combination of elongated, parallel vent apertures and from being removed therefrom. With the arcuate forward portion 46 of the strain relief clip 40 securely engaging an electrical cable 50, strain relief will be provided for the electrical cable, with its displacement relative to the cabinet or chassis to which it is coupled substantially restricted.

There has thus been shown a strain relief clip for an electrical cable which prevents displacement of the electrical cable relative to the cabinet or chassis of an electrical device to which it is coupled for maintaining integrity of the electrical coupling therebetween. The strain relief clip of the present invention is adapted to securely engage an electrical cable and to be inserted within and engage an elongated, parallel vent aperture within the cabinet or chassis of the electronic device. The strain relief clip may take the form of a uniquely configured single section of metal wire or a solid metal sheet uniquely shaped to perform the same functions. The present invention has general application to all electrical/electronic devices to which an electrical lead is coupled and is particularly adapted for use in modular electronic systems, such as in a modular electronic entertainment center or with the combination of a remote, portable keyboard and a computer terminal.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In an electronic apparatus having an electrical cable coupled thereto and at least one elongated, generally linear ventilation aperture therein, a strain relief clip for securing said electrical cable to said electronic apparatus and preventing relative motion therebetween, said strain relief clip comprising:

a generally cylindrical, first portion open at both ends havinga slot extending the length thereof and adapted to receive the electrical cable along a portion of the length thereof in tight-fitting relation;

an elongated, rigid, generally linear second portion adapted for insertion in said ventilation aperture along the length thereof and for engaging portions of said electronic apparatus immediately adjacent the lateral edges of said ventilation aperture when rotationally displaced after being inserted in said ventilation aperture so as to be aligned generally transverse to the length of said ventilation aperture; and an interconnecting portion coupling said first and second portions and positioned within and extending beyond said ventilation aperture, wherein the longitudinal axes of said first and second portions are in generally parallel alignment and said first clip portion is in spaced relation from said electronic apparatus to allow for the loose positioning of the strain relief clip within said ventilation aperture in facilitating the positioning upon and removal from the electronic apparatus of the strain relief clip.

2. A strain relief clip as in claim 1 wherein said first, second and interconnecting portions thereof are comprised of a single metal wire.

3. A strain relief clip as in claim 1 wherein said first, second and interconnecting portions thereof are comprised of a single piece of sheet metal.

4. A strain relief clip as in claim 1 wherein the electronic apparatus further includes second and third apertures positioned on respective sides of said at least one ventilation aperture and said second portion of said strain relief clip further comprises first and second engaging means for insertion in an engagement with said second and third apertures, respectively, when said strain relief clip is rotationally displaced.

5. A strain relief clip as in claim 1 wherein the electronic apparatus further includes second and third generally linear apertures aligned with said at least one elongated, generally linear ventilation aperture and on opposite sides thereof in spaced relation therewith, said generally linear second portion of said strain relief clip further comprising engaging means on respective ends thereof for insertion in and engagement with a respective one of said second and third generally linear apertures when said strain relief clip is rotationally displaced 90°.

6. A strain relief clip as in claim 5 wherein each of said engaging means comprises a hook-shaped member for engaging a respective edge of said second and third generally linear apertures.

7. A strain relief clip as in claim 6 wherein said electronic apparatus includes a cabinet and said apertures comprise a plurality of parallel slots arranged in a side-by-side array in said cabinet.

8. A strain relief clip as in claim 6 wherein said electronic apparatus includes a chassis and said apertures comprise a plurality of parallel slots arranged in a side-by-side array in said chassis.

9. A strain relief clip as in claim 1 wherein said first cylindrical portion of said strain relief clip is resilient to facilitate the insertion therein and removal therefrom of the electrical cable.

* * * * *